US010675728B2

(12) United States Patent
Chen

(10) Patent No.: US 10,675,728 B2
(45) Date of Patent: Jun. 9, 2020

(54) CUTTER HOLDER CAPABLE OF POLISHING

(71) Applicant: SHIN-YAIN INDUSTRIAL CO., LTD., Taichung (TW)

(72) Inventor: Chih-Hsiang Chen, Taichung (TW)

(73) Assignee: SHIN-YAIN INDUSTRIAL CO., LTD., Taichung (TW)

( * ) Notice: Subject to any disclaimer, the term of this patent is extended or adjusted under 35 U.S.C. 154(b) by 15 days.

(21) Appl. No.: 16/173,287

(22) Filed: Oct. 29, 2018

(65) Prior Publication Data

US 2020/0130129 A1 Apr. 30, 2020

(51) Int. Cl.

| | |
|---|---|
| ***B24B 27/00*** | (2006.01) |
| ***B24B 19/00*** | (2006.01) |
| ***B24B 29/00*** | (2006.01) |
| ***B24B 29/02*** | (2006.01) |
| *B24B 45/00* | (2006.01) |
| *B24B 19/22* | (2006.01) |

(52) U.S. Cl.

CPC ..... *B24B 27/0076* (2013.01); *B24B 19/009* (2013.01); *B24B 29/005* (2013.01); *B24B 29/02* (2013.01); *B24B 19/22* (2013.01); *B24B 45/006* (2013.01)

(58) Field of Classification Search

CPC . B24B 27/0076; B24B 19/009; B24B 29/005; B24B 29/02; B24B 19/22; B24B 45/006

USPC ..... 15/169

See application file for complete search history.

(56) References Cited

U.S. PATENT DOCUMENTS

| | | | | |
|---|---|---|---|---|
| 3,780,407 | A * | 12/1973 | Hoffecker | A46B 7/08 29/90.01 |
| 9,592,583 | B2 * | 3/2017 | Ishikawa | B24B 29/005 |
| 9,682,456 | B1 * | 6/2017 | McGeary | B24B 9/007 |
| 10,414,024 | B2 * | 9/2019 | Sato | B24B 33/085 |
| 2005/0153642 | A1 * | 7/2005 | Matsushita | A46B 13/008 451/526 |
| 2015/0165584 | A1 * | 6/2015 | Ishikawa | B24B 29/005 451/103 |
| 2015/0367477 | A1 * | 12/2015 | Hayashi | B24B 27/0069 451/59 |
| 2016/0016293 | A1 * | 1/2016 | Matsushita | A46D 1/00 451/532 |
| 2016/0128461 | A1 * | 5/2016 | Akashi | B24D 13/14 134/6 |
| 2017/0036323 | A1 * | 2/2017 | Sato | B24B 29/00 |

FOREIGN PATENT DOCUMENTS

| | | | | |
|---|---|---|---|---|
| DE | 202018106290 | U1 * | 11/2018 | B24D 13/14 |
| JP | 2005111640 | A * | 4/2005 | |
| JP | 5378330 | B2 * | 12/2013 | |
| JP | 3219966 | U * | 1/2019 | |
| TW | 572282 | U * | 1/2019 | |
| WO | 2017135616 | A1 * | 8/2017 | B24B 27/033 |

* cited by examiner

*Primary Examiner* — Marc Carlson

(74) *Attorney, Agent, or Firm* — Rosenberg, Klein & Lee

(57) ABSTRACT

The cutter holder capable of polishing a workpiece has a body, a mandrel, a middle element and a brush assembly. The mandrel extends into the body. The middle element is mounted to the body with a part of the mandrel extending out of the middle element. The brush assembly is mounted with the part of the mandrel that extends out of the middle element.

9 Claims, 9 Drawing Sheets

CUTTER HOLDER CAPABLE OF POLISHING

BACKGROUND OF THE INVENTION

1. Field of the Invention

The present invention relates to a cutter holder, and more particularly to a cutter holder capable of polishing.

2. Description of Related Art

Burrs are raised ridges or small pieces that are formed along the edges of a workpiece from operations such as drilling, milling and lathing Because burrs are usually sharp, they could be a safety hazard to the personnel. Therefore, a polishing process should be executed after a workpiece is machined from a machine tool. Operators usually have to use scrapers, sandpaper or brushes to remove the burrs from a workpiece.

However, the polishing process has the following shortcomings.

1. It takes manpower to execute the polishing process.
2. Using scrapers, sandpaper or brushes to remove the burrs consumes much time.
3. The polishing process requires manpower to carry out while the machine tool manufactures products in mass production. The speed of manpower is way too slow compared with the manufacturing speed of the machine tool. The manual process of polishing prolongs the whole manufacturing process.

SUMMARY OF THE INVENTION

The main objective of the present invention is to provide a cutter holder capable of polishing a workpiece, the cutter holder adapted to be mounted on a machine tool to execute a polishing process automatically.

The cutter holder capable of polishing a workpiece in accordance with the present invention has a body, a mandrel, a middle element, and a brush assembly. The mandrel extends into the body. The middle element is mounted to the body with a part of the mandrel extending out of the middle element. The brush assembly is mounted with the part of the mandrel that extends out of the middle element.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
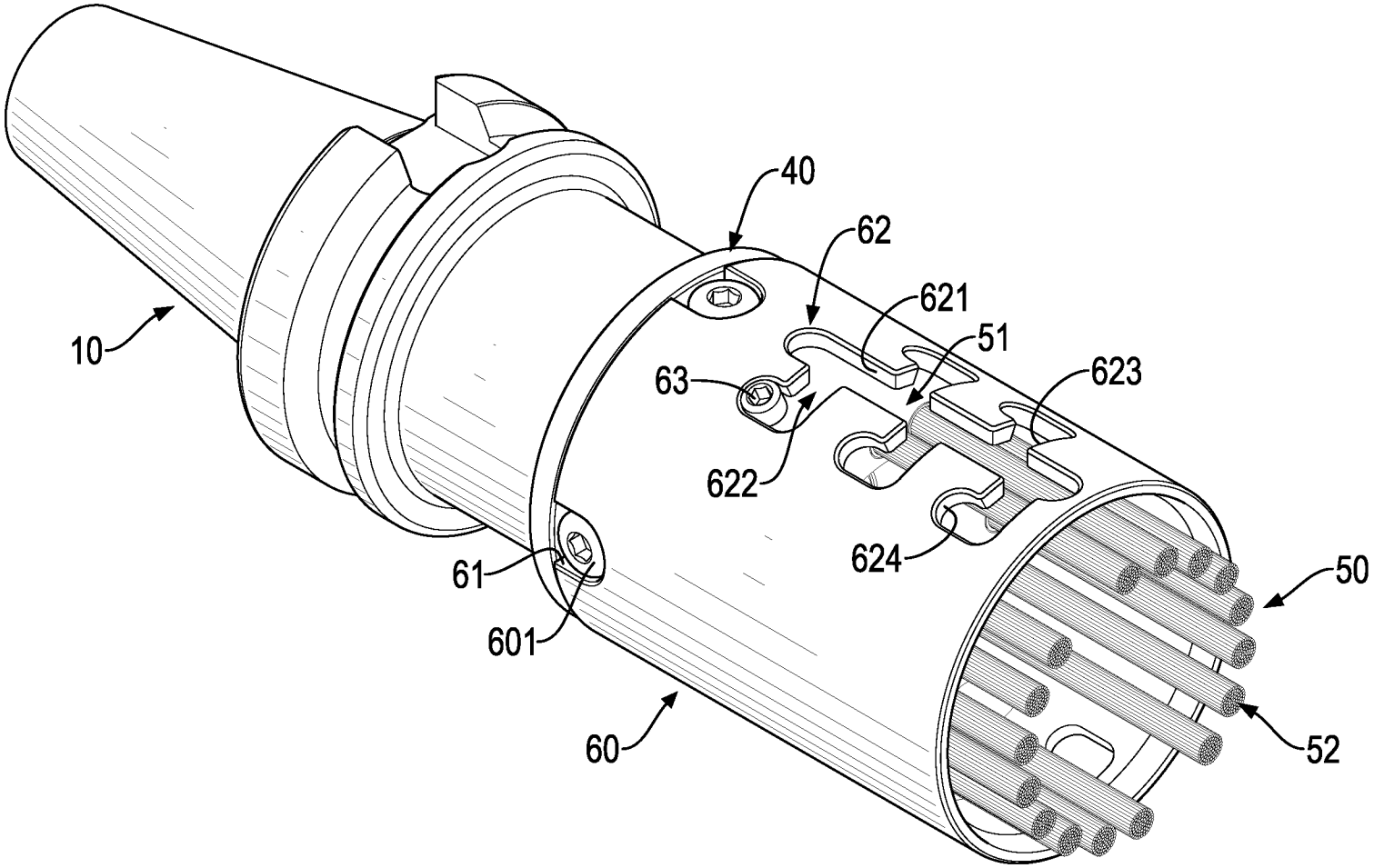
FIG. 1 is a perspective view of a cutter holder capable of polishing a workpiece in accordance with the present invention.
Figure 2:
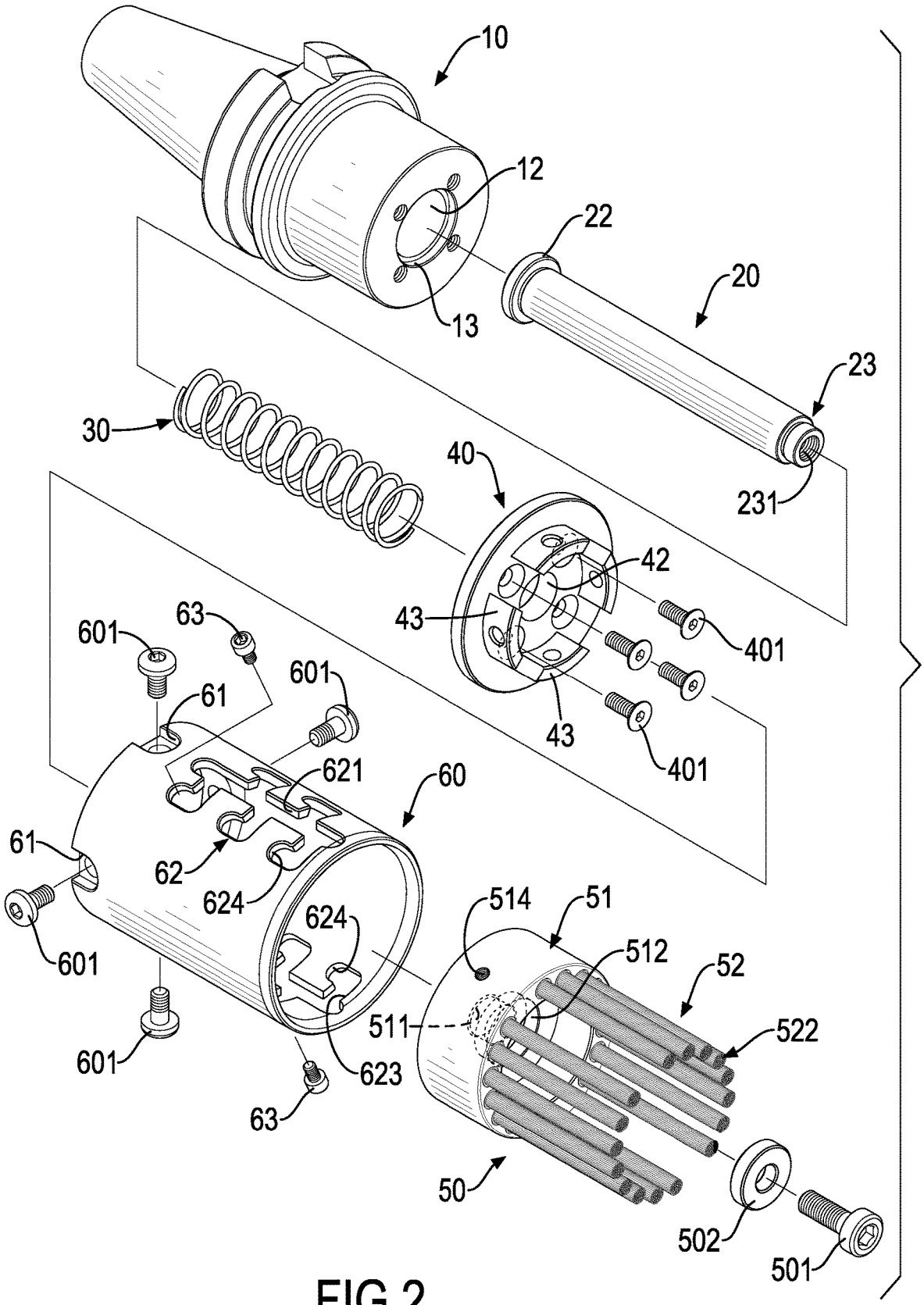
FIG. 2 is an exploded perspective view of the cutter holder capable of polishing a workpiece in FIG. 1.

With reference to FIGS. 1 and 2, a cutter holder capable of polishing a workpiece in accordance with the present invention comprises a body 10, a mandrel 20, an elastic element 30, a middle element 40, a brush assembly 50, and an adjusting cover 60.

Figure 4:
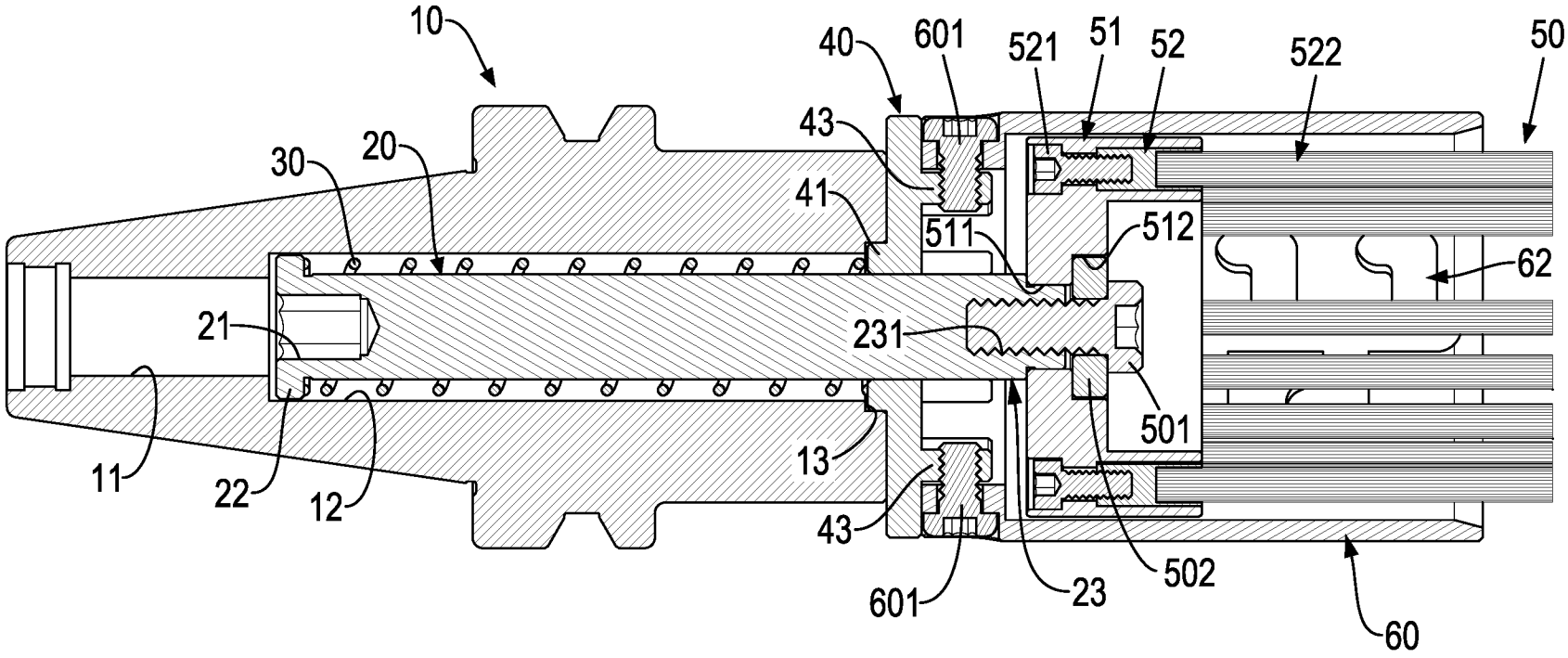
FIG. 4 is a cross-sectional side view of the cutter holder capable of polishing a workpiece in FIG. 1.

With reference to FIGS. 2 and 4, the body 10 has two opposite ends, a guiding hole 11, a receiving space 12, and a connecting trench 13. The guiding hole 11 is axially formed in the body 10 and extends from one of the two ends of the body 10 toward the other end of the body 10. The guiding hole 11 has an inner diameter. The receiving space 12 is axially formed in the body 10 from one of the two ends opposite to the guiding hole 11. The receiving space 12 communicates with the guiding hole 11 and has an inner diameter. The inner diameter of the receiving space 12 is larger than that of the guiding hole 11, which forms a flange between the receiving space 12 and the guiding hole 11. The connecting trench 13 is annularly and axially formed in the body 10 from one of the two ends opposite to the guiding hole 11 and communicates with the receiving space 12. The connecting trench 13 has an inner diameter larger than that of the receiving space 12.

With reference to FIGS. 2 and 4, the mandrel 20 extends through the connecting trench 13 of the body 10 into the receiving space 12, and abuts against the flange of the body 10. The mandrel 20 has a flat end surface, an outer surface, a containing hole 21, an abutting flange 22, and a connecting portion 23. The containing hole 21 is caved inwardly on the flat end surface of the mandrel 20 adjacent to the flange of the body 10, and coaxially communicates with the guiding hole 11 of the body 10. The abutting flange 22 protrudes annularly on the outer surface of the mandrel 20 adjacent to the flange of the body 10. The abutting flange 22 abuts against the flange of the body 10. The connecting portion 23 is disposed at the mandrel 20 away from the abutting flange 22 and extends out of the connecting trench 13. The connecting portion 23 has a connecting hole 231 caved inwardly at the connecting portion 23. Furthermore, the connecting hole 231 has an inner thread.

With reference to FIGS. 2 and 4, the elastic element 30 is stretched through the connecting trench 13 of the body 10 into the receiving space 12, surrounds the mandrel 20, and abuts against the abutting flange 22.

With reference to FIGS. 2 and 4, the middle element 40 may be an annular disc and has two surfaces, a passing hole 42, a connecting flange 41, multiple jointing units 43, and multiple fastening rods 401. The passing hole 42 is disposed through the middle element 40 and has an inner diameter corresponding to an outer diameter of the mandrel 20. The middle element 40 is mounted to the body 10 with the mandrel 20 extending through the passing hole 42. The connecting flange 41 protrudes axially on one of the two surfaces of the middle element 40 adjacent to the elastic element 30, and abuts against the elastic element 30. The shape of the connecting flange 41 corresponds to that of the connecting trench 13. Each one of the jointing units 43 protrudes axially on one of the two surfaces of the middle element 40 away from the connecting flange 41. The multiple jointing units 43 are arranged annularly around the passing hole 42 at spaced intervals. To assemble the middle element 40 with the body 10, insert the mandrel 20 through the passing hole 42 until the connecting flange 41 is well received in the connecting trench 13, and the elastic element 30 abuts against the connecting flange 41. Then fasten the multiple fastening rods 401 on the middle element 40 and the body 10 to fix the middle element 40 on the body 10 firmly.

Figure 3:
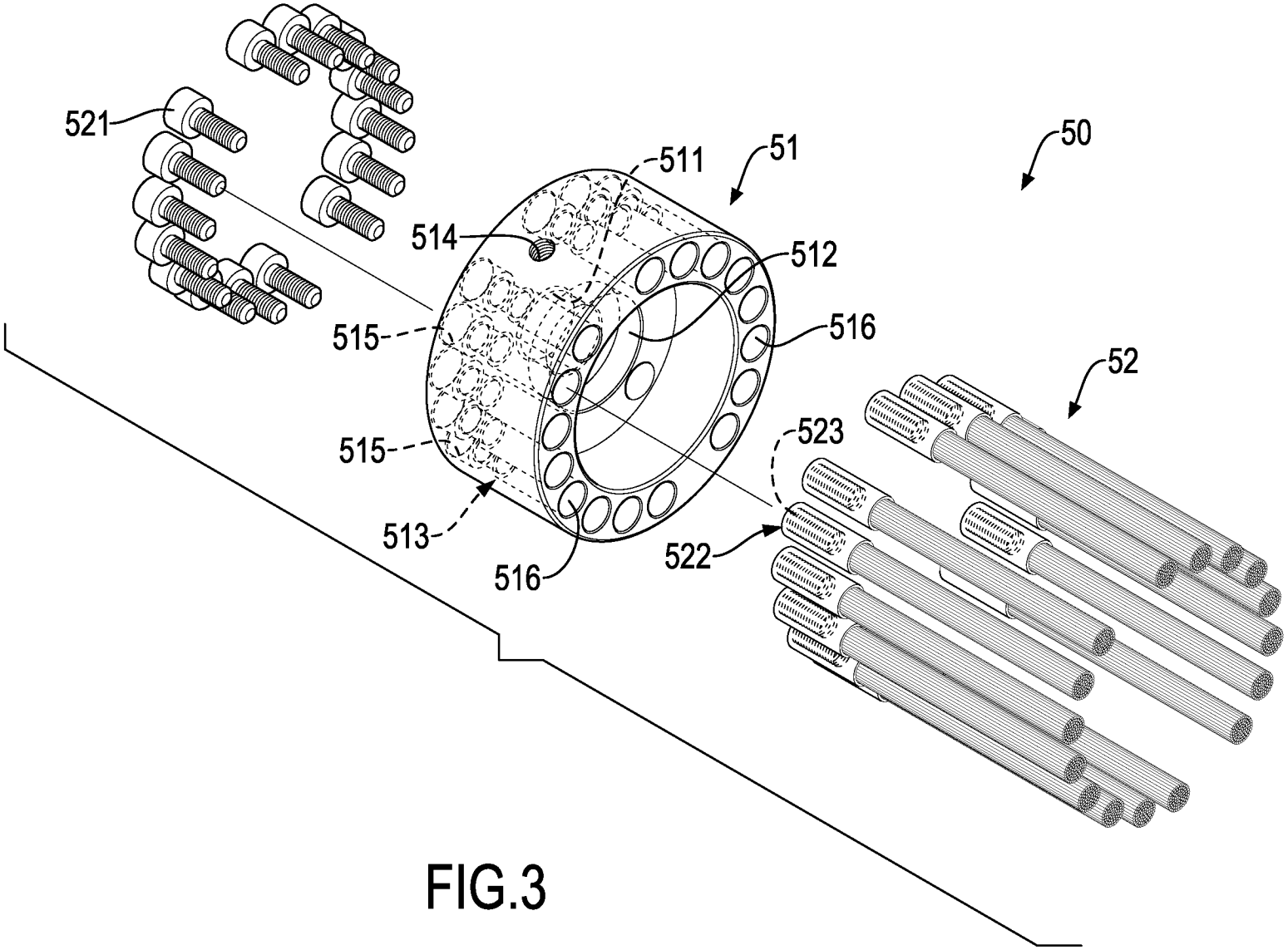
FIG. 3 is an exploded perspective view of a brush assembly of the cutter holder capable of polishing a workpiece in FIG. 1.

With reference to FIGS. 2 to 4, the brush assembly 50 is mounted with the connecting portion 23 of the mandrel 20, and has a connecting seat 51, a washer 502, a connecting rod 501, and multiple brush units 52. The connecting seat 51 is a cylinder with a hollow center, is mounted to the connecting portion 23, and has an outer surface. The connecting seat 51 has a through hole 511, a receiving recess 512, multiple containing spaces 513, and at least one positioning hole 514. The through hole 511 is caved inwardly on the connecting seat 51 adjacent to the connecting portion 23. The receiving recess 512 is caved inwardly on the connecting seat 51 away from the through hole 511 and coaxially communicates with the through hole 511. The receiving recess 512 has a diameter larger than a diameter of the through hole 511. With reference to FIG. 3, each one of the containing spaces 513 is disposed through the connecting seat 51 axially. The multiple containing spaces 513 are arranged annularly around the through hole 511 and the receiving recess 512 at spaced intervals. In the present invention, each one of the containing spaces 513 has a retaining hole 515 and a receiving hole 516. The retaining hole 515 is formed axially through the connecting seat 51 adjacent to the through hole 511. The receiving hole 516 is formed axially through the connecting seat 51 away from the retaining hole 515 and coaxially communicates with the retaining hole 515. The at least one positioning hole 514 is caved inwardly and radially on the outer surface of the connecting seat 51. Furthermore, the connecting seat 51 has two positioning holes 514, and the two positioning holes 514 are disposed coaxially on the connecting seat 51.

The washer 502 is mounted in the receiving recess 512. The connecting rod 501 is disposed through the washer 502 and the through hole 511, extends into the connecting hole 231 of the mandrel 20, and is connected with the connecting hole 231. Furthermore, the connecting rod 501 is threaded. By screwing the connecting rod 501 to the connecting hole 231, the brush assembly 50 is fixed on the mandrel 20. Each one of the brush units 52 is disposed in a respective one of the containing spaces 513. In the present invention, each brush unit 52 comprises a bolt 521 and a brush body 522. The bolt 521 is mounted in one of the retaining holes 515. The brush body 522 is mounted in the receiving hole 516 communicating to the corresponding retaining hole 515, and the brush body 522 has a threaded hole 523 on a surface of the brush body 522 adjacent to the retaining hole 515. To assemble each one of the brush units 52 on the connecting seat 51, screw the bolt 521 into the threaded hole 523 of the brush body 522. In the present invention, the brush body 522 is made of polyamide fiber, which enhances the structural strength and the wear resistivity of the brush body 522.

With reference to FIGS. 2 to 4, the adjusting cover 60 is mounted with the middle element 40 and surrounds the brush assembly 50. The adjusting cover 60 is a hollow cylinder and has an outer surface, a longitudinal direction, multiple jointing recesses 61, multiple fastening units 601, at least one communicating groove 62, and at least one adjusting element 63. Each one of the jointing recesses 61 is disposed on the adjusting cover 60 adjacent to a respective one of the jointing units 43 of the middle element 40. The multiple jointing recesses 61 are disposed on the adjusting cover 60 at spaced intervals. By disposing each one of the fastening units 601 through a respective one of the jointing recesses 61 and the corresponding one of the jointing units 43, the adjusting cover 60 is fixed on the middle element 40. The at least one communicating groove 62 is disposed through the outer surface of the adjusting cover 60, and has a propelling channel 621 and multiple positioning channels 622. The propelling channel 621 is disposed at a middle part of the at least one communicating groove 62, and extends along the longitudinal direction of the adjusting cover 60. The multiple positioning channels 622 are disposed at spaced intervals along the longitudinal direction of the adjusting cover 60. Each one of the positioning channels 622 communicates with the propelling channel 621 and comprises a connecting section 623 and a limiting recess 624. The connecting section 623 communicates with the propelling channel 621 laterally. The limiting recess 624 communicates with the connecting section 623 and extends toward the middle element 40 along the longitudinal direction of the adjusting cover 60. In the present invention, the at least one communicating groove 62 has five positioning channels 622. Furthermore, the adjusting cover 60 has two communicating grooves 62 with the same contour, and the two communicating grooves 62 are disposed symmetrically through the outer surface of the adjusting cover 60.

With reference to FIGS. 1 and 2, the at least one adjusting element 63 is disposed through the at least one communicating groove 62 and mounted in the at least one positioning hole 514 of the connecting seat 51. The at least one adjusting element 63 is moveable within the at least one communicating groove 62 so as to adjust the position of the brush assembly 50 relative to the adjusting cover 60. In the present invention, the adjusting cover 60 has two adjusting elements 63. Each one of the two adjusting elements 63 is disposed through a respective one of the two communicating grooves 62, and is mounted with the corresponding one of the two positioning holes 514 of the connecting seat 51. By moving the two adjusting elements 63 within the two communicating groove 62, the position of the brush assembly 50 relative to the adjusting cover 60 is adjusted.

To execute a polishing process, mount the body 10 on a machine tool by connecting the guiding hole 11 with a spindle of the machine tool. Then actuate the machine tool to make the cutter holder coaxially rotate with the spindle at high speed. When the brush assembly 50 is rotating, put a workpiece with a burr near the brush assembly 50, and make the burr contact the multiple brush units 52. The burr is removed by the high-speed rotation of each one of the brush bodies 522. In this way, the polishing process is executed automatically.

Figure 5:
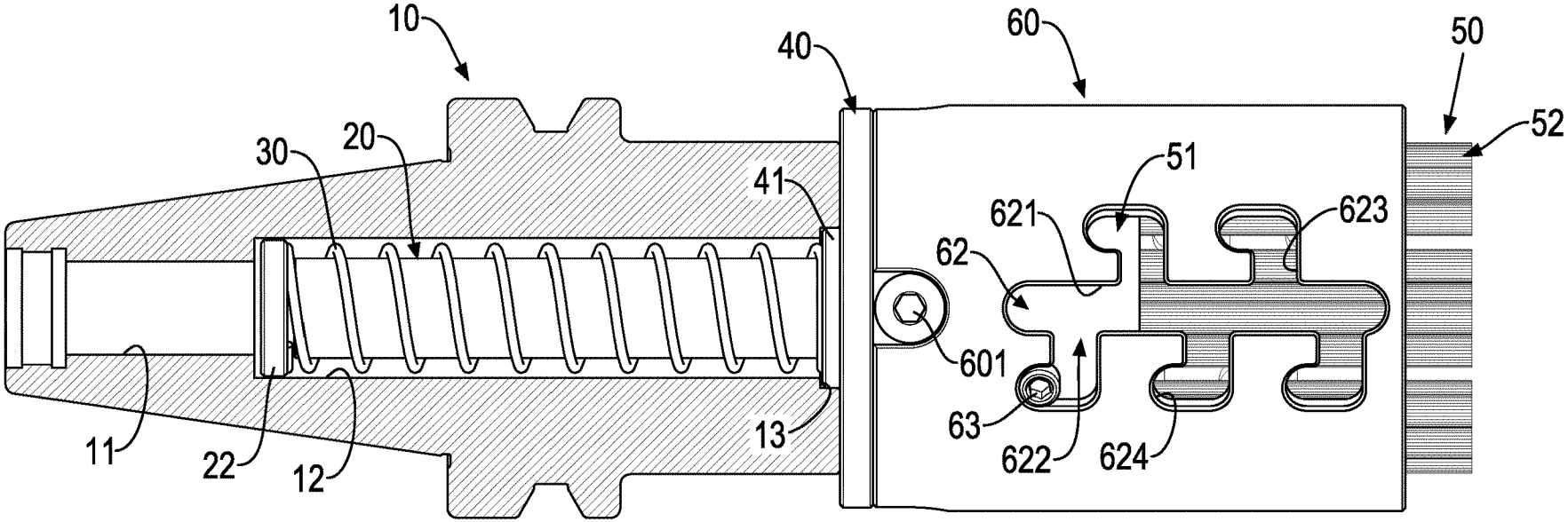
FIG. 5 is a side view in partial section of the cutter holder capable of polishing a workpiece in FIG. 1.
Figure 6:
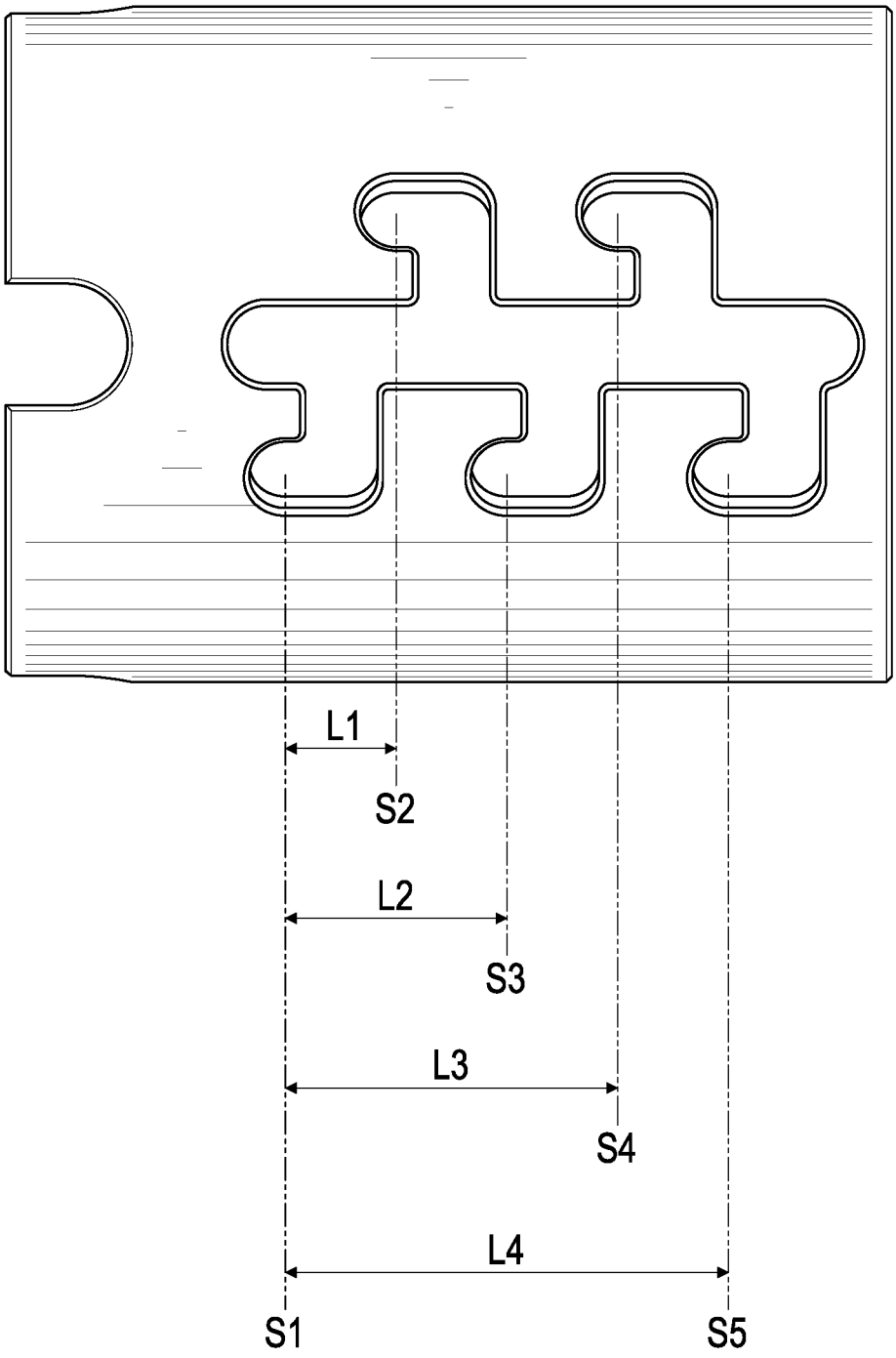
FIG. 6 is an enlarged side view in partial section of an adjusting cover of the cutter holder capable of polishing a workpiece in FIG. 1.

Drilling and milling generally leave burrs in a hole or a trench with a specific depth on a workpiece. In that case, the length of each one of the brush units 52 extending out from the adjusting cover 60 shown in FIGS. 1 and 5 may not be long enough to extend into the hole or the trench. In another case, the multiple brush units 52 may wear out after a long-term use. Under these circumstances, the brush assembly 50 needs to extend out from the adjusting cover 60. With reference to FIGS. 5 and 6, the at least one adjusting element 63 is initially located at a limiting recess 624, which is defined as the position S1. To further extend the brush assembly 50 out from the adjusting cover 60, move the at least one adjusting element 63 into the connecting section 623, and then push the at least one adjusting element 63 along the connecting section 623 into the propelling channel 621. Next, push the at least one adjusting element 63 along the propelling channel 621 toward the direction opposite to the middle element 40. Being fixed on the mandrel 20, the brush assembly 50 brings along the mandrel 20 to move toward the same direction. At the same time, the elastic element 30 that is disposed between the abutting flange 22 and the connecting flange 41 would be compressed.

Figure 7:
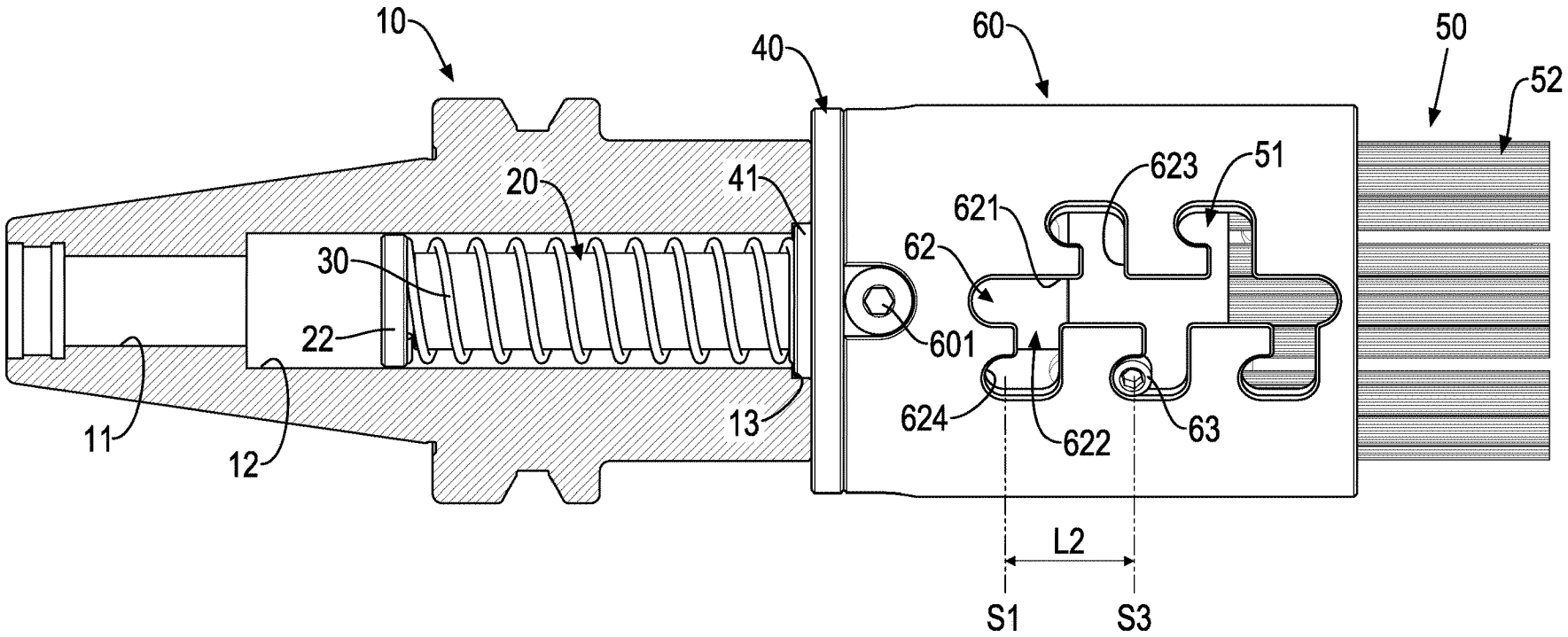
FIG. 7 is another side view in partial section of the cutter holder capable of polishing a workpiece in FIG. 1.

After pushed toward the direction opposite to the middle element 40 into the propelling channel 621, the at least one adjusting element 63 should be pushed into the positioning channel 622 as shown in FIG. 7. Then move the at least one adjusting element 63 along the connecting section 623 until it reaches a junction of the connecting section 623 and the limiting recess 624. The elastic element 30 would elongate automatically and bring the mandrel 20 to move along the direction opposite to the middle element 40. Being fixed on the mandrel 20, the brush assembly 50 would move toward the same direction as the mandrel 20 until the at least one adjusting element 63 moves into the limiting recess 624, which is also defined as the position S3. With reference to FIG. 7, the at least one adjusting element 63 moves from the position S1 to the position S3, which makes the brush assembly 50 extend out from the adjusting cover 60 for a length L2.

Figure 8:
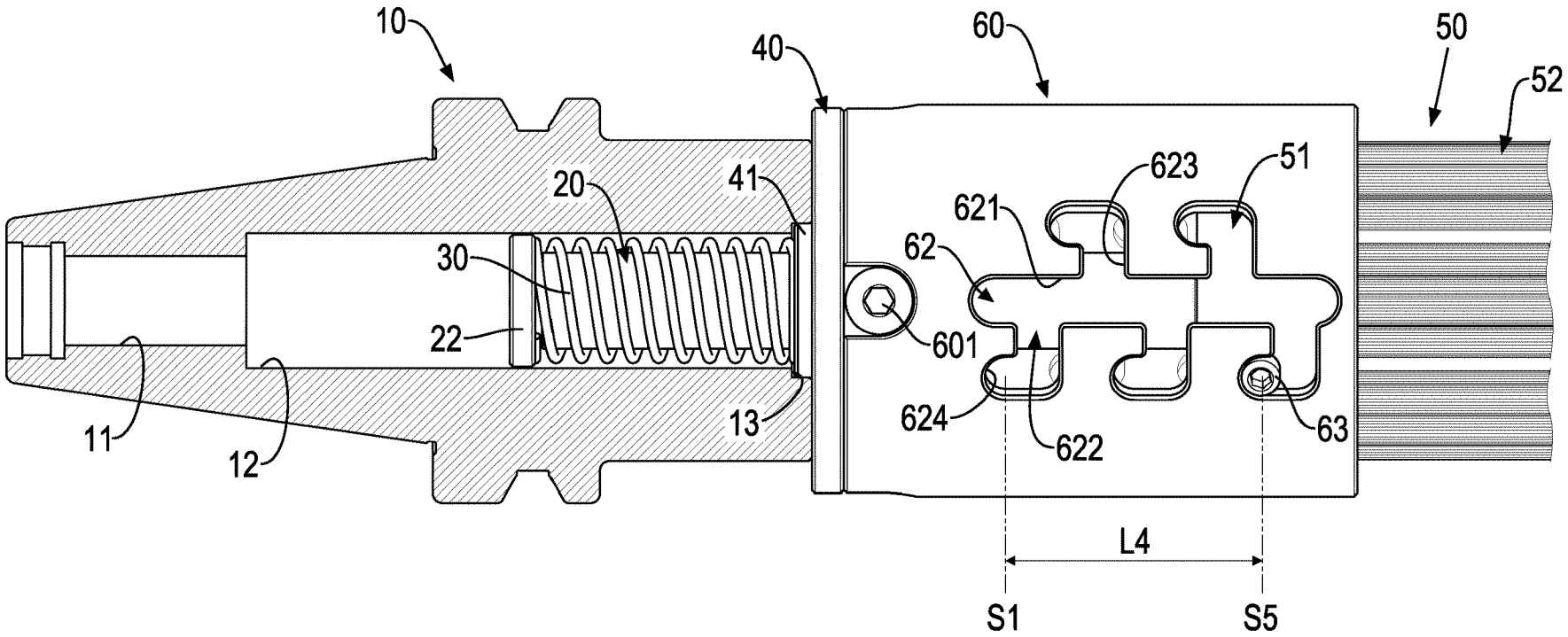
FIG. 8 is a further side view in partial section of the cutter holder capable of polishing a workpiece in FIG. 1.
Figure 9:
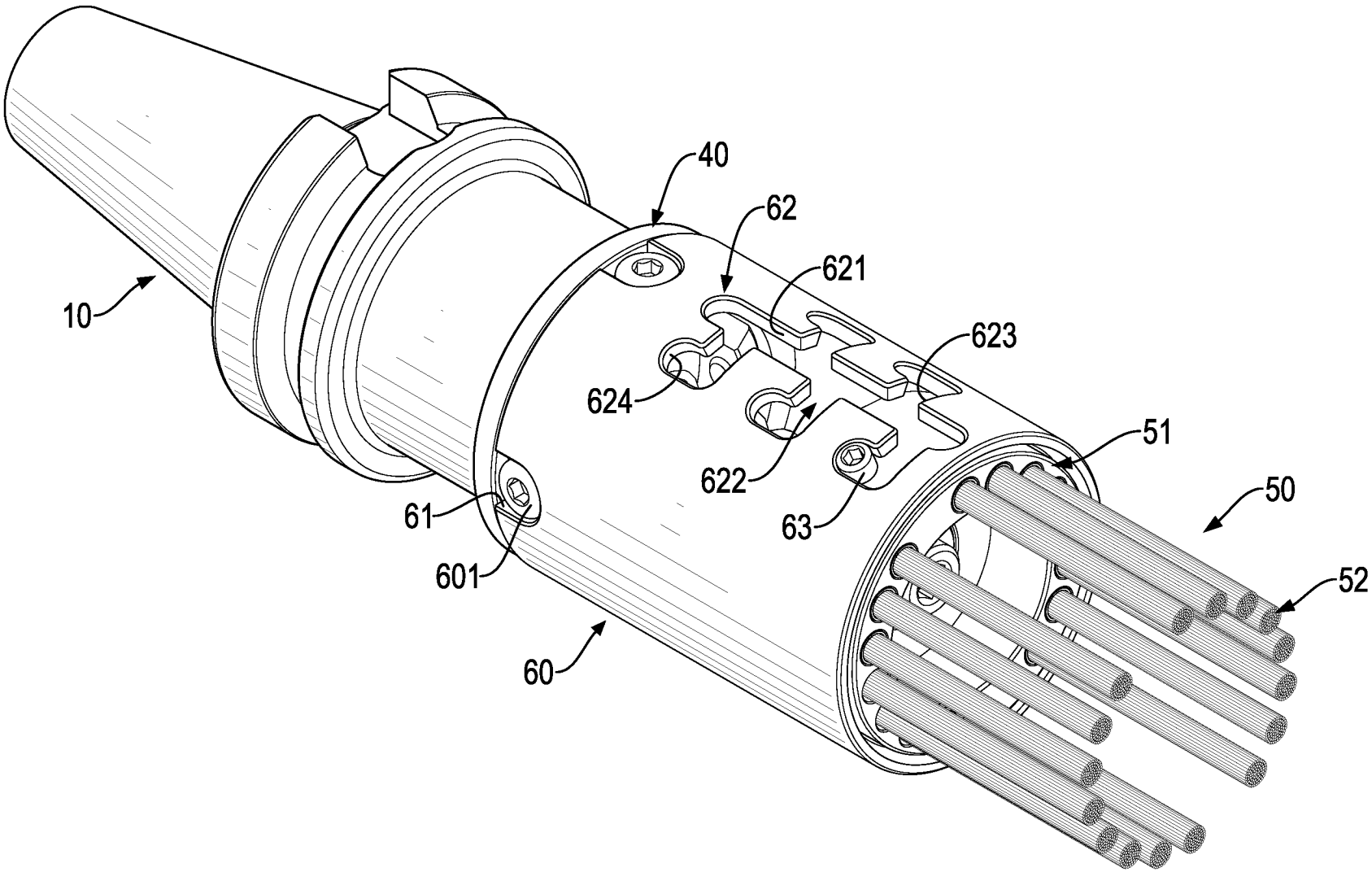
FIG. 9 is a perspective view of the cutter holder capable of polishing a workpiece in FIG. 8.

To make the brush assembly 50 extend out from the adjusting cover 60 for a length larger than the length L2, move the at least one adjusting element 63 into the limiting recess 624 as shown in FIG. 8, which is the furthest limiting recess 624 away from the middle element 40 and also defined as the position S5. The process of moving the at least one adjusting element 63 from the position S1 to the position S5 is same as the process of moving the at least one adjusting element 63 from the position S1 to the position S3. With reference to FIGS. 6 and 8, after moving the at least one adjusting element 63 from the position S1 to the position S5, the at least one adjusting element 63 moves for a distance L4, which also makes the brush assembly 50 extend out from the adjusting cover 60 for a length of L4 as shown in FIG. 9.

When the multiple brush units 52 are worn out, replace the long-term used brush assembly 50 from the mandrel 20 with a new one. To remove the brush assembly 50 from the mandrel 20, insert a tip of a screwdriver into the containing hole 21 as shown in FIG. 4 and hold a handle of the screwdriver firmly to fix the mandrel 20. Then insert a tip of another screwdriver into the connecting rod 501 and spin the handle to loosen the connecting rod 501 from the connecting hole 231. If there is only one brush unit 52 that is worn out, remove the bolt 521 from the threaded hole 523 of the brush body 522 to disassemble the worn-out brush unit 52 without having to replace the used brush assembly 50 with a new brush assembly 50.

With the aforementioned technical characteristics, the cutter holder capable of polishing a workpiece in accordance with the present invention has the following advantages.

1. The cutter holder capable of polishing a workpiece is mounted on a machine tool to execute a polishing process automatically, which reduces the labors needed.

2. Compared with the time needed to use scrapers, sandpaper or brushes to remove the burrs, the automatic process requires less time.

3. The time required for executing the whole manufacturing process shortens due to the time reduced in executing the polishing process.

4. By moving the at least one adjusting elements 63 within the at least one communicating groove 62, the position of the brush assembly 50 relative to the adjusting cover 60 is adjustable. The length of the brush assembly 50 extending out from the adjusting cover 60 is also adjustable thereby.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A cutter holder capable of polishing a workpiece, the cutter holder comprising:
- a body;
- a mandrel extending into the body;
- a middle element mounted to the body with a part of the mandrel extending out of the middle element;
- a brush assembly mounted with the part of the mandrel that extends out of the middle element; and
- an adjusting cover mounted with the middle element, surrounding the brush assembly, and having
  - a longitudinal direction;
  - at least one communicating groove disposed through the adjusting cover and having
    - a propelling channel disposed at a middle part of the at least one communicating groove and extending along the longitudinal direction of the adjusting cover; and
    - multiple positioning channels disposed at spaced intervals along the longitudinal direction of the adjusting cover, and each one of the positioning channels communicating with the propelling channel;
- wherein the brush assembly has
  - at least one positioning hole caved inwardly and radially on the brush assembly; and
  - at least one adjusting element disposed through the at least one communicating groove and mounted in the at least one positioning hole.

2. The cutter holder capable of polishing a workpiece as claimed in claim 1 further having an elastic element stretched into the body and surrounding the mandrel; wherein
- the mandrel has
  - an outer surface;
  - an abutting flange protruding annularly on the outer surface of the mandrel; and
  - the elastic element is disposed between the abutting flange of the mandrel and the middle element.

3. The cutter holder capable of polishing a workpiece as claimed in claim 2, wherein the brush assembly has
- a connecting seat mounted to the mandrel and having
  - multiple containing spaces respectively disposed through the connecting seat axially, and each containing space having
    - a retaining hole formed axially through the connecting seat; and
    - a receiving hole formed axially through the connecting seat away from the retaining hole and coaxially communicating with the retaining hole; and
- multiple brush units each disposed in a respective one of the containing spaces and having a bolt mounted in one of the retaining holes; and a brush body mounted in the receiving hole communicating with the corresponding retaining hole and having a threaded hole on a surface of the brush body adjacent to the retaining hole and the bolt being able to be screwed in the threaded hole;

wherein the at least one positioning hole is caved inwardly and radially on the connecting seat.

4. The cutter holder capable of polishing a workpiece as claimed in claim 3, wherein the brush body of each one of the brush units is made of polyamide fiber.

5. The cutter holder capable of polishing a workpiece as claimed in claim 4, wherein each one of the positioning channels comprises a connecting section communicating with the propelling channel laterally; and a limiting recess communicating with the connecting section and extending toward the middle element along the longitudinal direction of the adjusting cover.

6. The cutter holder capable of polishing a workpiece as claimed in claim 5, wherein the mandrel has an outer diameter; and a connecting portion disposed away from the abutting flange, extending out of the body, and having a connecting hole caved inwardly at the connecting portion;

the elastic element abuts against the abutting flange;

the middle element has a passing hole disposed through the middle element and having an inner diameter corresponding to the outer diameter of the mandrel, which enables the mandrel to extend through the passing hole of the middle element; and the connecting seat of the brush assembly has a through hole caved inwardly on the connecting seat adjacent to the connecting portion; and the multiple containing spaces arranged annularly around the through hole at spaced intervals; and the brush assembly is mounted with the connecting portion of the mandrel and has a connecting rod disposed through the through hole, extending into the connecting hole of the mandrel, and connected with the connecting hole.

7. The cutter holder capable of polishing a workpiece as claimed in claim 6, wherein the connecting hole has an inner thread; and the connecting rod is a threaded rod able to be screwed into the connecting hole.

8. The cutter holder capable of polishing a workpiece as claimed in claim 7, wherein the connecting seat has two positioning holes disposed co-axially on the connecting seat; and the adjusting cover has two communicating grooves with the same contour and disposed symmetrically through the adjusting cover; and two adjusting elements respectively disposed through the two communicating grooves, and mounted in the corresponding one of the two positioning holes of the connecting seat.

9. The cutter holder capable of polishing a workpiece as claimed in claim 7, wherein the body has two opposite ends;

a guiding hole axially formed in the body away from the middle element and having an inner diameter;

a receiving space axially formed in the body from one of the two ends opposite to the guiding hole, communicating with the guiding hole, and having an inner diameter larger than the inner diameter of the guiding hole, thereby forming a flange between the receiving space and the guiding hole; and a connecting trench annularly and axially formed in the body from one of the two ends opposite to the guiding hole, communicating with the receiving space, and having an inner diameter larger than the inner diameter of the receiving space;

the mandrel extends through the connecting trench of the body into the receiving space and has the abutting flange abutting against the flange of the body; and the connecting portion extending out of the connecting trench of the body;

the middle element has two surfaces; and a connecting flange protruding axially on one of the two surfaces adjacent to the elastic element, abutting against the elastic element away from the abutting flange, and being in a shape corresponding to a shape of the connecting trench; and the elastic element is stretched through the connecting trench of the body into the receiving space.

* * * * *